US008544765B1

(12) United States Patent
Cornell et al.

(10) Patent No.: US 8,544,765 B1
(45) Date of Patent: Oct. 1, 2013

(54) LONG RANGE SOLID STREAM NOZZLE

(76) Inventors: Donald E. Cornell, New Port Richey, FL (US); William M. Farrell, Walton, NY (US)

( * ) Notice: Subject to any disclaimer, the term of this patent is extended or adjusted under 35 U.S.C. 154(b) by 0 days.

(21) Appl. No.: 13/200,387

(22) Filed: Sep. 23, 2011

Related U.S. Application Data

(62) Division of application No. 11/898,395, filed on Sep. 12, 2007, now abandoned.

(60) Provisional application No. 60/843,707, filed on Sep. 12, 2006, provisional application No. 60/903,527, filed on Feb. 27, 2007.

(51) Int. Cl.
*B05B 17/04* (2006.01)

(52) U.S. Cl.
USPC ..... 239/11; 239/1; 239/16; 239/124; 239/423; 239/461; 239/462; 239/589; 239/590.5

(58) Field of Classification Search
USPC ..... 239/1, 11, 16, 17, 373, 423, 424, 239/461, 462, 505, 513, 514, 589, 590, 590.5, 239/600, 124, 127; 169/46, 47, 54, 66, 69, 169/70; 175/67, 424
See application file for complete search history.

(56) References Cited

U.S. PATENT DOCUMENTS

| | | | | |
|---|---|---|---|---|
| 204,950 | A * | 6/1878 | Clark | 239/589 |
| 4,848,672 | A * | 7/1989 | Matsumoto et al. | 239/590.5 |
| 5,170,946 | A * | 12/1992 | Rankin | 239/600 |
| 5,368,228 | A * | 11/1994 | Adamson et al. | 239/590.5 |
| 5,878,966 | A * | 3/1999 | Asakawa et al. | 239/590 |
| 5,931,392 | A * | 8/1999 | Adams | 239/589 |
| 6,851,632 | B2 * | 2/2005 | Ferrazza et al. | 239/590 |
| 2007/0095946 | A1 | 5/2007 | Ryan | |

* cited by examiner

*Primary Examiner* — Steven J Ganey
(74) *Attorney, Agent, or Firm* — Harbin & Hein PLLC

(57) ABSTRACT

A solid stream nozzle providing an extend throw-distance achieved by reducing boundary layer effects within the nozzle bore and/or by accelerating peripheral regions of the ejected stream in order to help maintain cohesion of a free liquid stream without appreciable dispersion. The method includes generating a high-pressure fluid source, supplying the nozzle with high pressure; reducing boundary layer effect within the nozzle bore, and optionally, accelerating and/or inwardly re-directing the peripheral boundary of the ejected stream with a secondary higher pressure, higher speed fluid source. The apparatus includes a high pressure fluid source, a nozzle bore, a bleed ring within the nozzle bore to strip off a boundary layer, and optionally, a secondary higher pressure fluid source at the nozzle tip to accelerate and/or inwardly re-direct the ejected fluid stream. The invention has application in large scale fire-fighting, irrigation, decontamination, weaponization, entertainment/amusement, and other fields requiring a long throw distance.

16 Claims, 13 Drawing Sheets

LONG RANGE SOLID STREAM NOZZLE

CROSS-REFERENCE TO RELATED PATENT APPLICATIONS

This is a divisional of U.S. patent application Ser. No. 11/898,395 filed Sep. 12, 2007 now abandoned, which claims the benefit of Provisional Application Ser. No. 60/843,707 filed Sep. 12, 2006 in the name of Donald E. Cornell and entitled Collimating Nozzle for Ejecting Coherent Fluid Stream.

This invention also claims the benefit of Provisional Application Ser. No. 60/903,527 filed Feb. 27, 2007 in the names of Donald E. Cornell and William M. Farrell, which is also entitled Collimating Nozzle for Ejecting Coherent Fluid Stream. The substance of these applications is incorporated herein.

BACKGROUND

This invention concerns a solid stream nozzle, but more specifically, to a stream collimating nozzle capable of throwing fluid, e.g., water, a relatively long range before dispersion. The invention is useful in large scale fire-fighting (particularly oil/gas/chemical industry, forest fires, and high-rise buildings), fireboats, irrigation, large scale decontamination, weaponization, entertainment/amusement, and other fields that utilize a solid stream or that require longer effective reach or stream trajectory before dispersion.

The effective reach or maximum throw distance achieved by conventional long range nozzles is typically around than 350-400. In firefighting technology, effective reach (or effective range) has been defined as the distance of travel of most of the water within a four square foot area when aiming the stream about 30° above horizon, which provides effective penetration of the firestream against rapidly rising thermal columns. A state-of-the-art 100 psi firefighting nozzle manufactured by Williams Fire & Hazard Control, Inc. of Vidor, Tex., for example, claims to have an effective reach of 478 feet but this would vary according to elevation and prevailing winds. Higher operating pressures (due to imperfections or discontinuities that disrupt laminar flow within the nozzle bore) degrade achievable range. In fact, it has been stated that overpressuring a smooth bore nozzle beyond 70 psi degrades stream quality because of increase nozzle turbulence, and results in a stream that "rags" or "feathers" around the edges due to unequal velocity generated by water rubbing against the sides of the nozzle. See, *Fire Stream Management Handbook*, David P. Fornelll, PennWell Publishing Company, 1991 (p. 180).

Foamed liquids, on the other hand, may be thrown further, e.g., perhaps up to 500 to 1000 feet, due to higher viscosity or cohesiveness of the ejected fluid stream, but foams are costly for firefighting applications. Large bore water fountain nozzles have been reported to reach about 750 feet vertically but these require a significant amount of power to operate and are not mobile, or cohesive.

SUMMARY OF THE INVENTION

According to a first aspect of the invention, there is provided a method of projecting a substantially coherent fluid stream comprising generating a high-pressure fluid source, supplying a nozzle with said high pressure fluid source, reducing boundary layer effects within a bore of said nozzle, and ejecting the coherent fluid stream after reducing said boundary layer effects. The boundary layer may be removed by removing or bleeding off a thin peripheral layer of fluid from a bore of said nozzle, and the pressure of this fluid may be increased and supplied to an accelerating tip of the nozzle to generate a higher speed annular jet around the periphery of ejected. fluid stream after ejection from said nozzle. A viscosifier may also be injected into the fluid stream which is in the nozzle.

Another aspect of the invention comprises a nozzle that projects a substantially coherent stream of fluid, e.g., water, by reducing boundary layer effects within a fluid path thereof, such as by bleeding boundary layer fluid from a peripheral region of the fluid path and/or by providing a higher speed fluid jet near an outlet of the nozzle to accelerate or re-direct a peripheral region of the stream.

In accordance with yet a further aspect of the invention, there is provided a solid stream nozzle comprising a first flange to receive fluid from a pressurized fluid source (200 to 1000 psi) through a first bore thereof, a second flange that mates and is axially aligned with the first flange to receive said fluid through a second bore that is smaller than said first bore, a chamber defined between the first and second flanges to remove a boundary layer of fluid from a peripheral region of the bores between the first and second flanges, and a tip to eject the solid stream of fluid. The first flange may include a flow straightener. A pump may be included to receive and further pressurize the boundary layer fluid and to supply higher pressure fluid to an accelerator chamber circumscribing the tip to produce an annular jet around the ejected stream. The tip assembly may also include a contoured discharge ring that is axially positionable to adjust the mass flow volume of an annular jet by altering the gap width between the discharge ring and the tip. The pressurized source may be derived from a pressurized tank holding fluid. The nozzle may also include an injector tube to inject a viscosifier or gelling agent.

Other aspects of the invention will become apparent upon review of the following description taken in conjunction with the accompanying drawings. The invention, though, is pointed out by the appended claims.

DESCRIPTION OF ILLUSTRATIVE EMBODIMENTS

Figure 1:
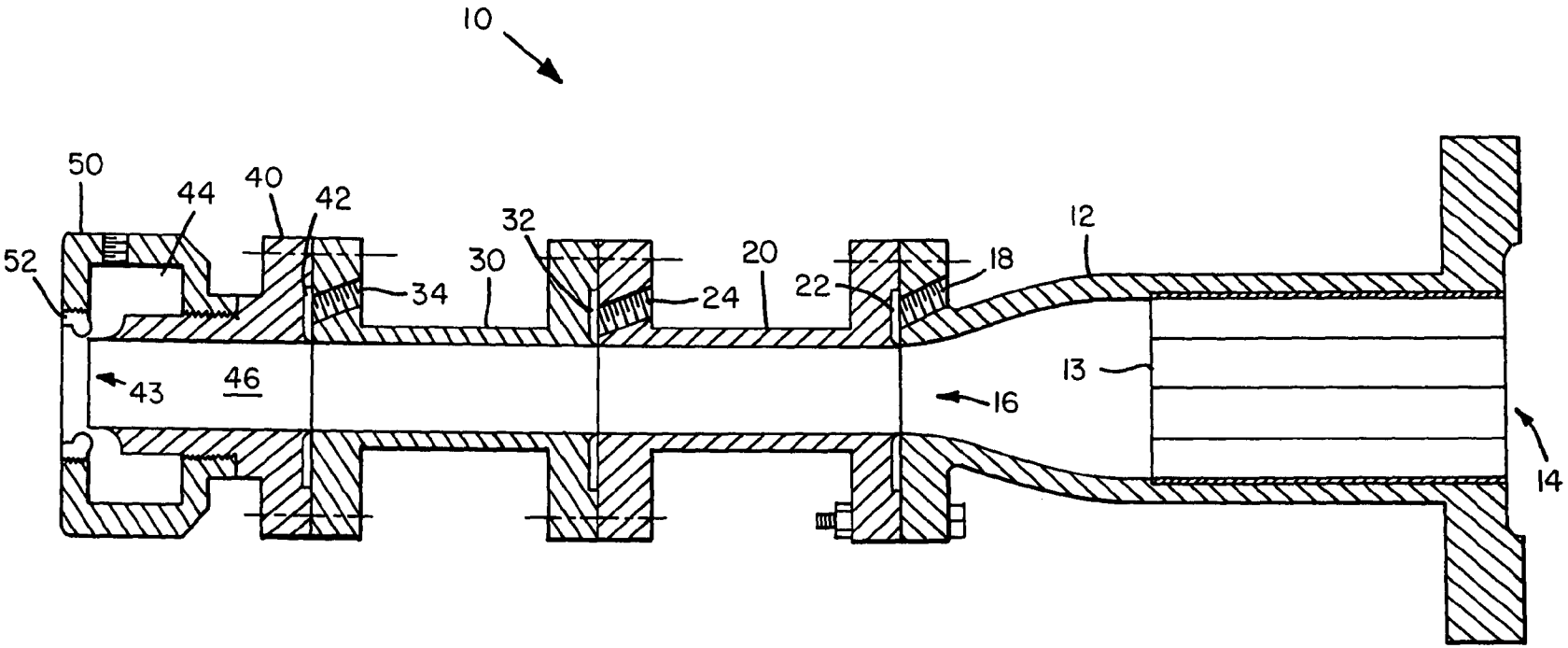
FIG. 1 depicts a cross-sectional view of a solid stream nozzle according to one embodiment of the present invention.

FIG. 1 shows an exemplary a nozzle assembly 10 according to one embodiment of the invention that ejects a coherent, collimated stream of water or other fluid a relatively great distance. A reducing flange 12 of assembly 10 receives fluid, e.g., water, at inlet 14 from a pressurize source. Flow straightener 13 disposed within a lower velocity section of flange 12 serves to minimize swirls, eddies, and irregular flows that may reside in the fluid stream at the nozzle inlet. In a prototype model of the nozzle, inlet bore of flange 12 is approximately four inches, which bore is reduced to approximately 1.8 inches at outlet 16 of the reducing flange. This embodiment of nozzle assembly 10 includes two intermediate flange sections 20 and 30, and an accelerator tip assembly 40 that ejects a substantially coherent fluid stream.

The radius of the internal bore of intermediate flange 20 is constant along its axial length but about five thousandths of an inch (0.005") smaller that the preceding bore of reducing flange 12 at outlet 16. This radial differential between bores may be larger or smaller than five thousandths of an inch depending on the nature of the fluid, viscosity, pressure, flow rate, and/or other parameters. The smaller bore of flange 20 allows bleeding of a peripheral ring of fluid into an annular chamber 22 between flanges 12 and 20. As fluid passes through the nozzle bores, the bleed ring removes a peripheral portion of the fluid stream whose speed has been reduced by friction caused by boundary layer effects of the internal bore of reducing flange 12. Fluid collected in chamber 22 may be discarded or supplied to a secondary high pressure source that feeds higher pressure fluid to an accelerator chamber 44 of ejector tip flange 40. A threaded tap 18 is cut into reducing flange 12 to receive a connector tube to extract boundary layer fluid in chamber 22. Likewise, intermediate flange 30 and accelerator tip flange 40 define bleed chambers 32 and 42, which also include threaded taps 32 and 34 to extract boundary layer fluid from the fluid stream.

Fluid within chambers 22, 32, and 42 is supplied to a high-pressure pump, e.g., a gerotor or other type of pump, which increases the fluid stream's primary pressure to supply an increased pressure to chamber 44 of the accelerator tip flange 40. A secondary high pressure source of about 10-40% higher than the primary pressure source at inlet 14 is believed sufficient to produce an annular jet of higher-speed fluid flow to accelerate the outer peripheral region of the primary fluid steam ejected at outlet 43 of the accelerator tip flange 40. In any event, the pressure differential between the primary and secondary source is selected to attain equiplanar fluid discharge at the ejector tip 43, i.e., a constant fluid velocity across the diameter of the primary stream after exiting the nozzle.

To achieve a continuous collimated stream, the primary and secondary fluid pressures may be generated by respective axial flow pumps of the type disclosed in U.S. Pat. No. 7,108,569 entitled Axial Flow Pump or Marine Propulsion Device. Unlike centrifugal pumps, such a device produces a relatively constant pressure without significant pressure perturbations that deleterious impact stream cohesion.

Alternatively or for intermittent operation, the respective primary and secondary pressure sources may be derived from pressurized tanks of water or other fluid such as that disclosed, for example, by U.S. Pat. No. 6,789,748. In this case, fluid from boundary layer chambers 22, 32, and 42 may be discarded, or recovered and re-circulated in the supply line. Primary and secondary pressurization for the primary and secondary flows may be provided by an inert gas, such as Nitrogen, $CO_2$, high pressure steam, or other gas. Yet further, the pressurized source of fluid may comprise a combination of inert gas pressurization of a tank and a pump to simultaneously supply fluid to the pressurized tank. A regulator may also be employed to control or maintain a constant pressure. Unlike prior solid stream nozzles that operate in the range of eighty to one hundred pounds per square inch (psi), the pressure of the primary stream of this invention operates is intended to operate above 150 to 200 psi. The general operating ranges lies between 150-1000 psi but the invention is not limited to this range. Machining tolerances, bore circularity (assuming cylindrical bores are used), and alignment between the respective flange sections may have a greater impact on stream cohesion at higher pressures.

Still referring again to FIG. 1, flange 30 is similar in structure to flange 20, but the radius of the internal bore of flange 30 is about five thousandths of an inch (0.005") smaller than the bore of flange 20. This also enables removal of an outer boundary layer from the fluid stream that has been slowed by the internal walls of the bore of flange 20. Flange 20 similarly includes a threaded tap 24 to extract boundary layer fluid accumulating in chamber 32.

The internal bore of accelerator tip flange 40 is five thousandths of an inch (0.005") smaller than the bore of flange 30. Again, the bore differential between this or other sections may vary as explained above. The bore differential allows additional boundary layer fluid to be removed from the fluid stream passing through the bore of flange 30. Although two intermediate flanges are shown between reducing flange 12 and accelerator tip 40, zero or additional intermediate flanges may be employed. If additional intermediate flanges are employed, their bores and the bore of nozzle tip may be further successively decreased from the size of the starting bore at outlet 43 of the reducing flange. Moreover, the amount of bore reduction for any or all of the flanges, i.e., five thousandths of an inch (0.005"), may be increased or decreased to achieve effective removal of the boundary layer in the respective flange sections. In the illustrated embodiment, the bores are constant along there axes in each of the intermediate and accelerator tip flanges, but alternative embodiments may comprise expanding bores in the downstream direction in order to bleed off a boundary layer at the junction of each flange section. In addition, the invention is not limited to cylindrical bores, and thus, other cross-sectional shapes may be employed.

Successively removing boundary layers of the fluid stream in each flange section helps to achieve equiplanar discharge (i.e., a constant fluid velocity across the diameter of the ejected stream) at outlet 43 of the ejector tip. Fluid in bore 46 of the accelerator tip, however, tends to expand after discharge due to release of confinement pressure imposed by the nozzle and thus causing stream dispersion and decreased throw distance of the solid stream nozzle 10. The accelerator tip flange 40 counteracts this expansion. There is also a vena contracta phenomenon to deal with during trial and calibration of the nozzle.

To counteract expansion occurring at the discharge outlet 43 of flange 40, an annular ring of higher pressure fluid in chamber 44 is forced between the nozzle outlet bore and an adjustable discharge ring 52 of housing 50. The higher pressure fluid is applied against ejected stream to help maintain stream cohesion. Adjustable discharge ring 52 is threaded into housing 50 so that its contoured surface may be axially re-positioned to direct varying amounts of a higher speed fluid that is inwardly forced against the primary fluid stream. In addition, the discharge ring is geometrically configured to direct the secondary jet approximately four degrees (4°) (more or less) inwardly of the longitudinal axis of fluid flow. The extent of this oblique angle may be altered according to flow volumes, pressures, and/or other parameters in order to achieve equiplanar discharge in the primary stream. In effect, the discharge ring 52 may be axially re-positioned to alter the mass flow of an annular ring of fluid against the primary stream to counteract dispersion due to release of confinement pressure of the primary stream thereby to collimate the fluid stream after discharge.

Figure 2:
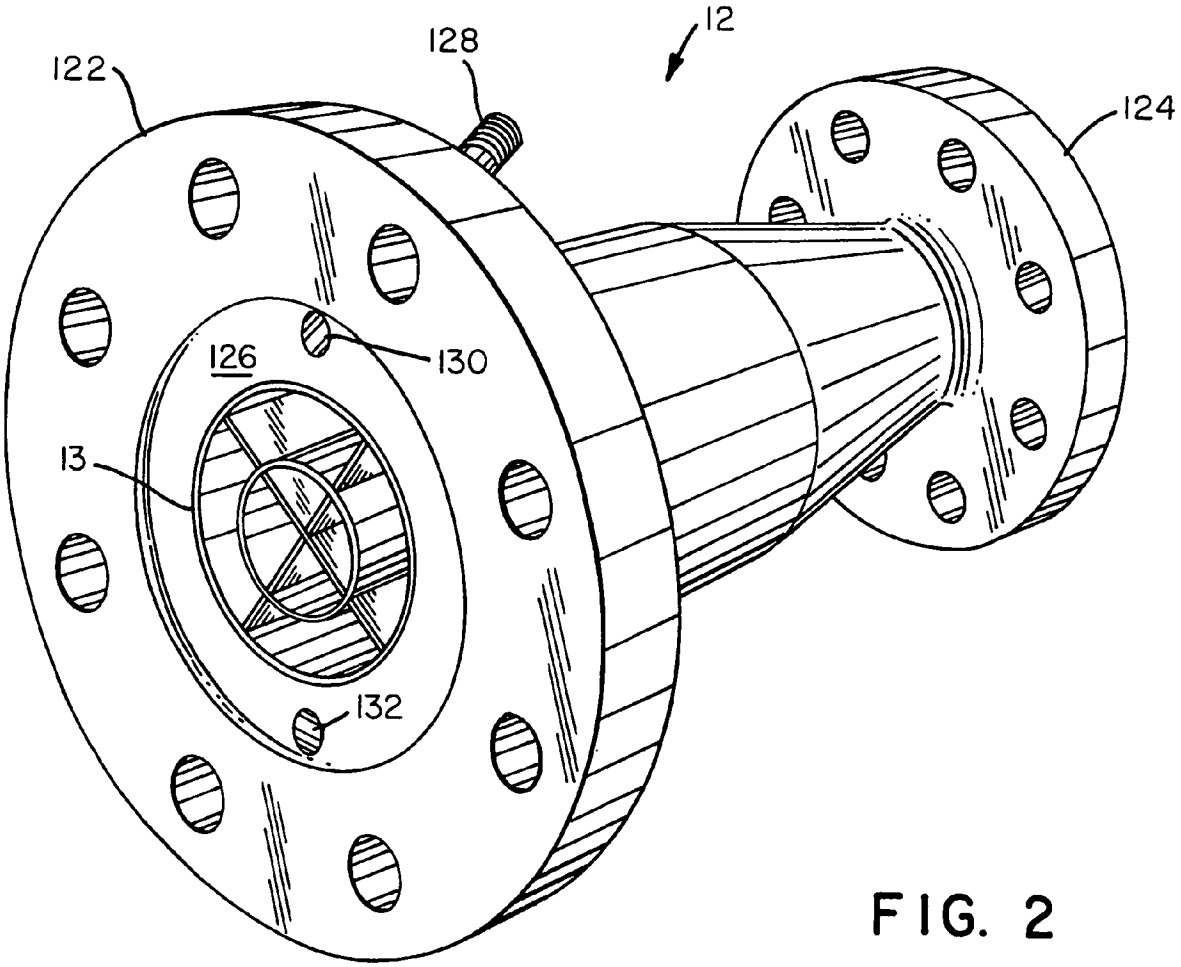
FIG. 2 shows the reducing section of the nozzle of FIG. 1, which includes a flow straightener disposed in the inlet portion thereof.

FIG. 2 is a perspective view of the reducing flange 12 of FIG. 1 viewed from its fluid inlet end. As shown, reducing flange 12 has an inlet collar 122 that attaches to a frame, as well as an outlet collar 124 that attaches to an intermediate flange or directly to the collar of the discharge tip. Flow straightener 13 lies inside the larger portion of the reducing flange bore. A recess 126 is cut a desired depth in the face of collar 122 to form a chamber between mating collars of the reducing flange the frame flange of a pressure source. This chamber may be used to supply a pressure probe to measure or detect the supply pressure of the primary fluid stream, or to recover pressurized fluid obtained elsewhere from the nozzle. A pair of tubes 128 (only one shown) that communicate with taps 130, 132 provide a passage through which to return boundary layer fluid bled from chambers 22, 32, and 42 (FIG. 1) to a chamber formed by recess 126 thereby to recover and re-circulate boundary layer fluid.

Figure 3:
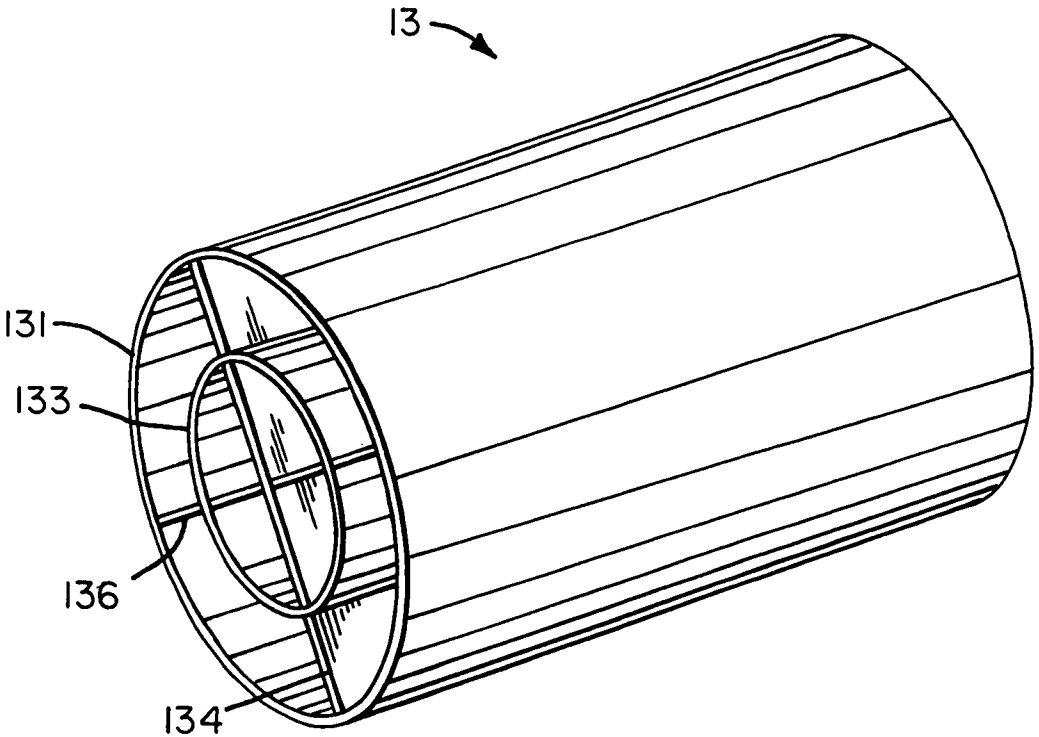
FIG. 3 shows the flow straightener of FIG. 2.

FIG. 3 illustrates one of many designs of a flow straightener 13 disposed in the reducing flange 12. The exemplary flow straightener illustrated herein comprises a pair of concentric cylinders 131 and 133 having a series of perpendicular and axially aligned vanes 134 and 136. These vanes function to straighten fluid flow.

Figure 4:
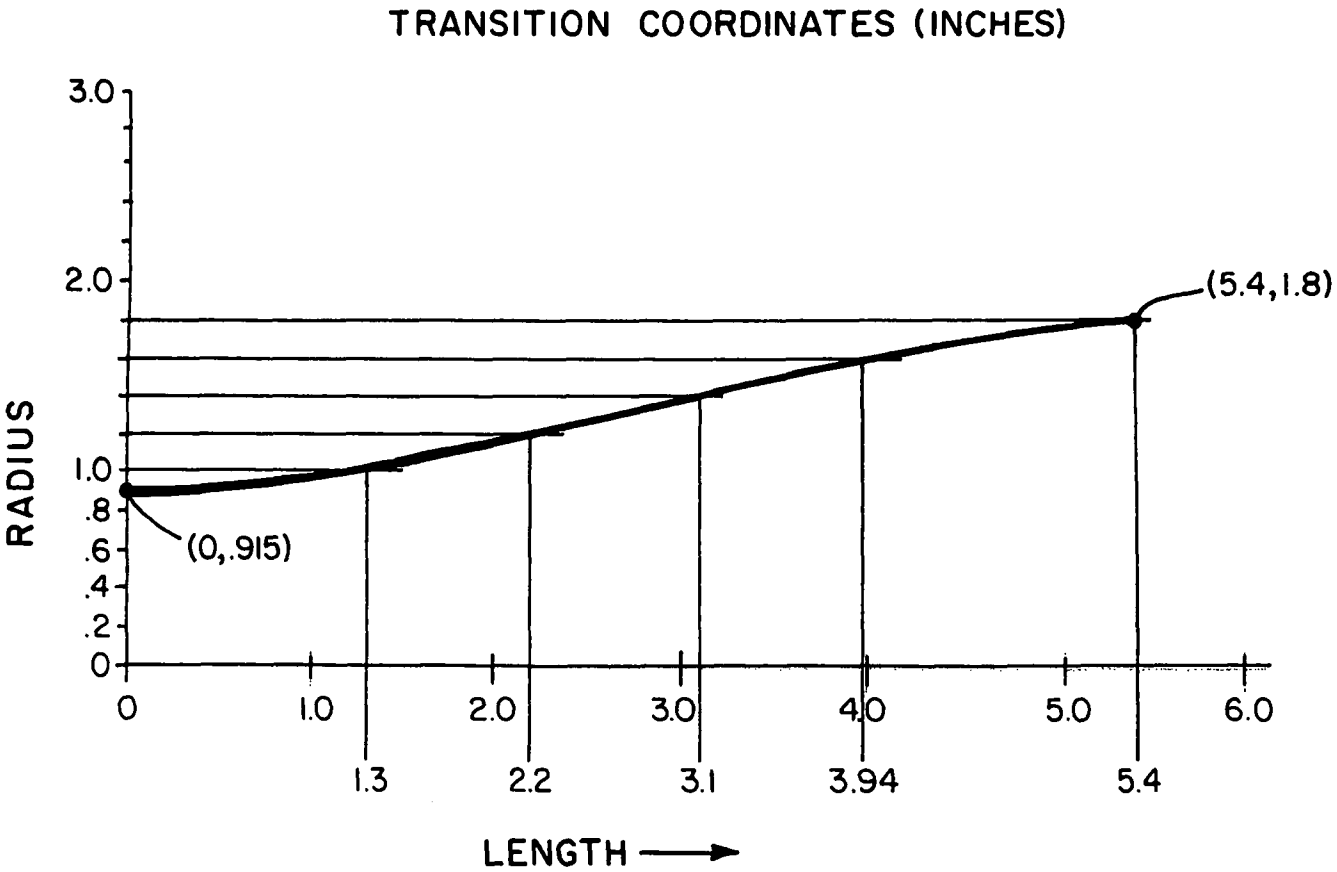
FIG. 4 shows an exemplary reducing contour for the reducing flange of FIG. 2.

FIG. 4 depicts transition coordinates for producing the reducing section of reducing flange 12, which are selected to help maintain laminar fluid flow. In an exemplary reducing flange, the radius of the bore at the discharge outlet 16 measures 0.915 inches, which is increased to 1.8 inches at a distance of 5.4 inches from the discharge outlet 16. The solid line shows the radius in inches between the discharge outlet 16 and a point 5.4 inches therefrom.

Figure 5B:
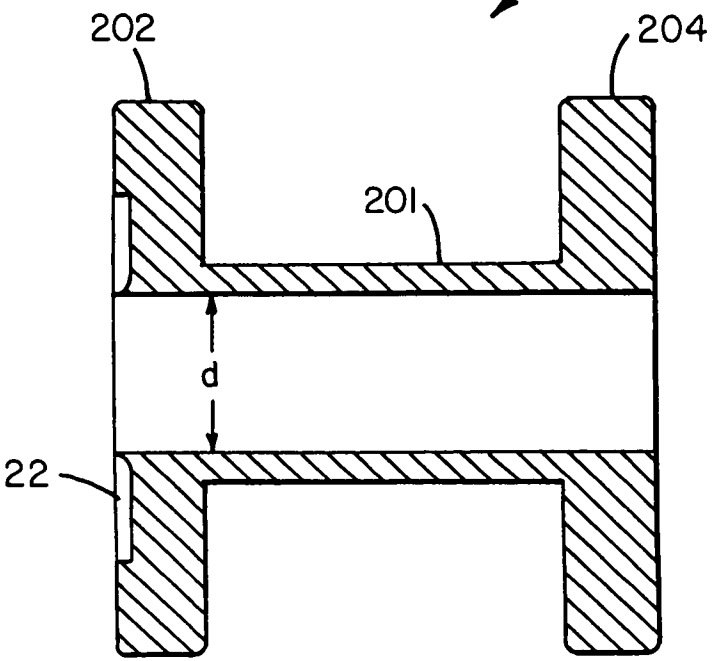
FIGS. 5A and 5B show one of the intermediate flanges of the nozzle assembly of FIG. 1.
Figure 5A:
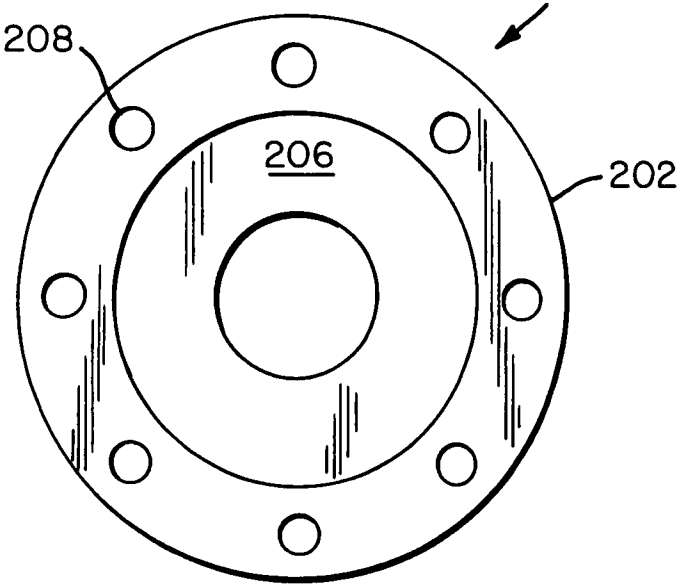

FIGS. 5A and 5B show an intermediate flange 20 (or 30) of FIG. 1 where like reference numerals depict like elements. As shown, flange 20 includes a shaft 201, inlet collar 202, and a discharge collar 204. Inlet collar 202 includes a recess 206 cut into the surface thereof to form the chamber 22 (FIG. 1) to receive boundary layer fluid. The bore diameter "d" of shaft 201 is slightly smaller that the outlet bore diameter of the reducing flange 12 in order to scavenge off a boundary layer from the fluid stream passing into the chamber 22, as previously explained. As series of bore holes 208 are provided to attach the inlet collar 202 of intermediate flange 20 with the outlet collar 124 (FIG. 2) of reducing flange 12. Intermediate flange 30 is similarly constructed but having a slightly smaller bore, as previously explained.

Figure 6A:
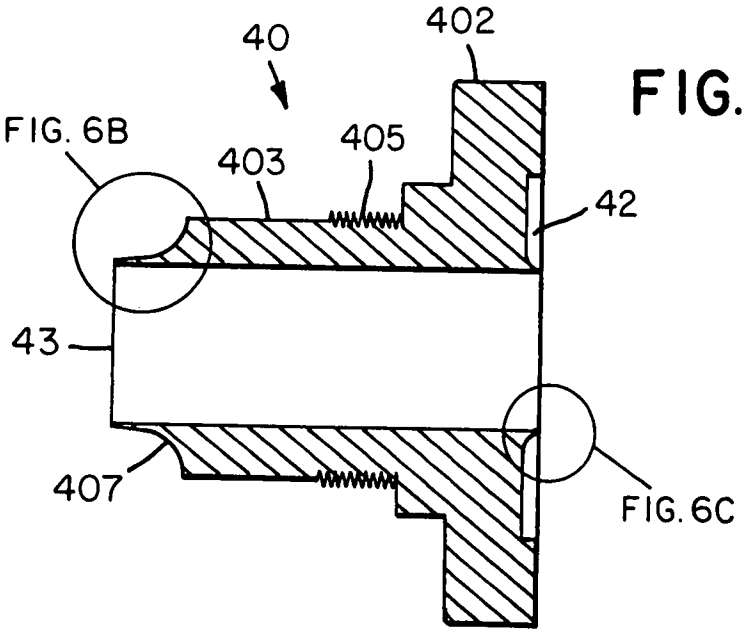
FIG. 6A shows details for the accelerator tip flange.
Figure 6B:
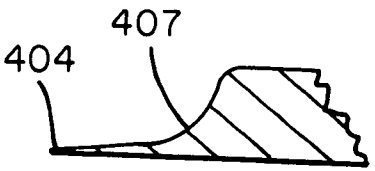
FIG. 6B shows a feathered edge of the accelerator tip flange at its outlet.
Figure 6C:
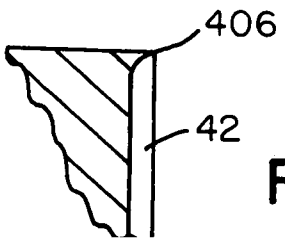
FIG. 6C shows the scraper edge at the inlet side of the accelerator flange to remove a speed-retarded boundary layer from the primary fluid stream passing through the nozzle bore.

FIGS. 6A, 6B, and 6C show further details of the accelerator tip flange 40 of FIG. 1. The accelerator tip flange functions to compress inwardly and/or to accelerate the speed of outer peripheral region of the primary solid stream. Inlet collar 402 includes a recess 42 cut into the collar to form a chamber to receive boundary layer fluid, as previously explained. A surface 403 of the accelerator tip flange forms chamber 44 (FIG. 1) when housing 50 (FIG. 1) couples the flange 40 via threads cut therein. A contoured surface 407 machined around the outer edge of the nozzle bore at discharge 43 forms a fluid guide with adjustment ring 52 (FIG. 1) of housing 50 (FIG. 1) when coupled with the accelerator flange 40. FIG. 5B shows the contour 407 and the sharp edge 404 formed thereby. FIG. 6C shows a portion of chamber 42 and a sharp edge 406 formed in collar 402 at the flange inlet that serves to scavenge boundary layer fluid from the outlet of the preceding flange, which has a slightly larger bore diameter. Due to close machine tolerance required, each of the flange sections may include alignment pins to properly align sections of the nozzle assembly.

Figure 7A:
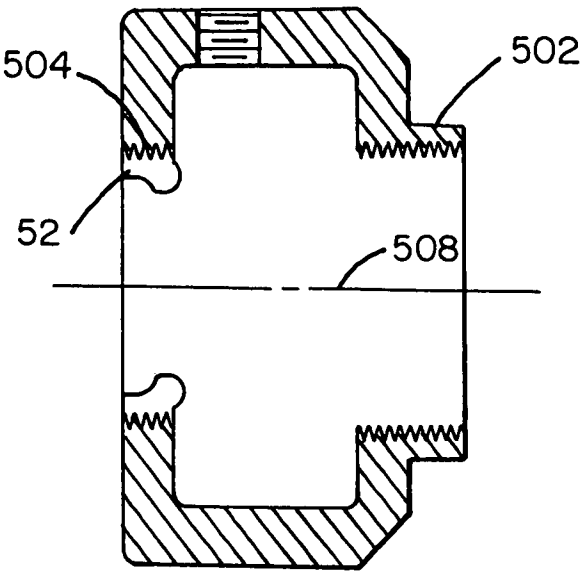
FIG. 7A shows the accelerator tip housing details and an adjustment ring threaded therein to adjust the mass flow volume of an annular jet ejected about the periphery of the primary solid stream.
Figure 7B:
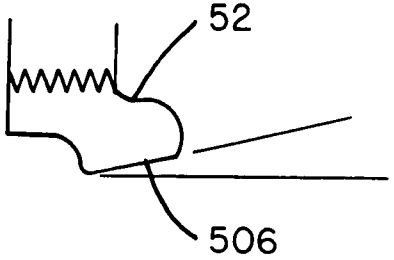
FIG. 7B shows an exemplary contour of the adjustment ring to adjust the size, pressure, angle of incident, and/or fluid volume of the accelerated ring of fluid bearing against the outer periphery of the primary fluid stream.

FIGS. 7A and 7B depict housing 50 of FIG. 1 that couples the accelerator flange 40 to form the chamber 42. The neck 502 of housing 50 includes threads that mate with threads 405 (FIG. 6A) of the accelerator tip flange 40. The longitudinal or axial position of adjustment ring 52 may be adjusted by turning the ring within mating threads 504. Movement longitudinally of the discharge ring 52 varies the gap width between contour 407 (FIG. 6B) and surface 506 of the adjustment ring. The gap width controls mass flow volume of the secondary fluid flow at that accelerator tip, which is adjusted according to the primary pressure supplied to the primary fluid stream. The primary pressure level impacts the extent of stream expansion upon discharge of the solid stream and this must be counteracted with an inward force provided by the secondary jet at the accelerator tip. In the exemplary embodiment, an inner surface 506 of discharge ring 52 is flat (in its cross-sectional view) and provides a 4° (plus or minus 0.5°) inward fluid flow angle with the longitudinal axis 508 of the fluid stream. The downstream edge of surface 506 is slightly rounded to minimize flow disruption of the secondary jet. Surface 506 serves to compress outward expansion of the fluid stream to help maintain cohesion of the primary fluid stream.

Figure 8:
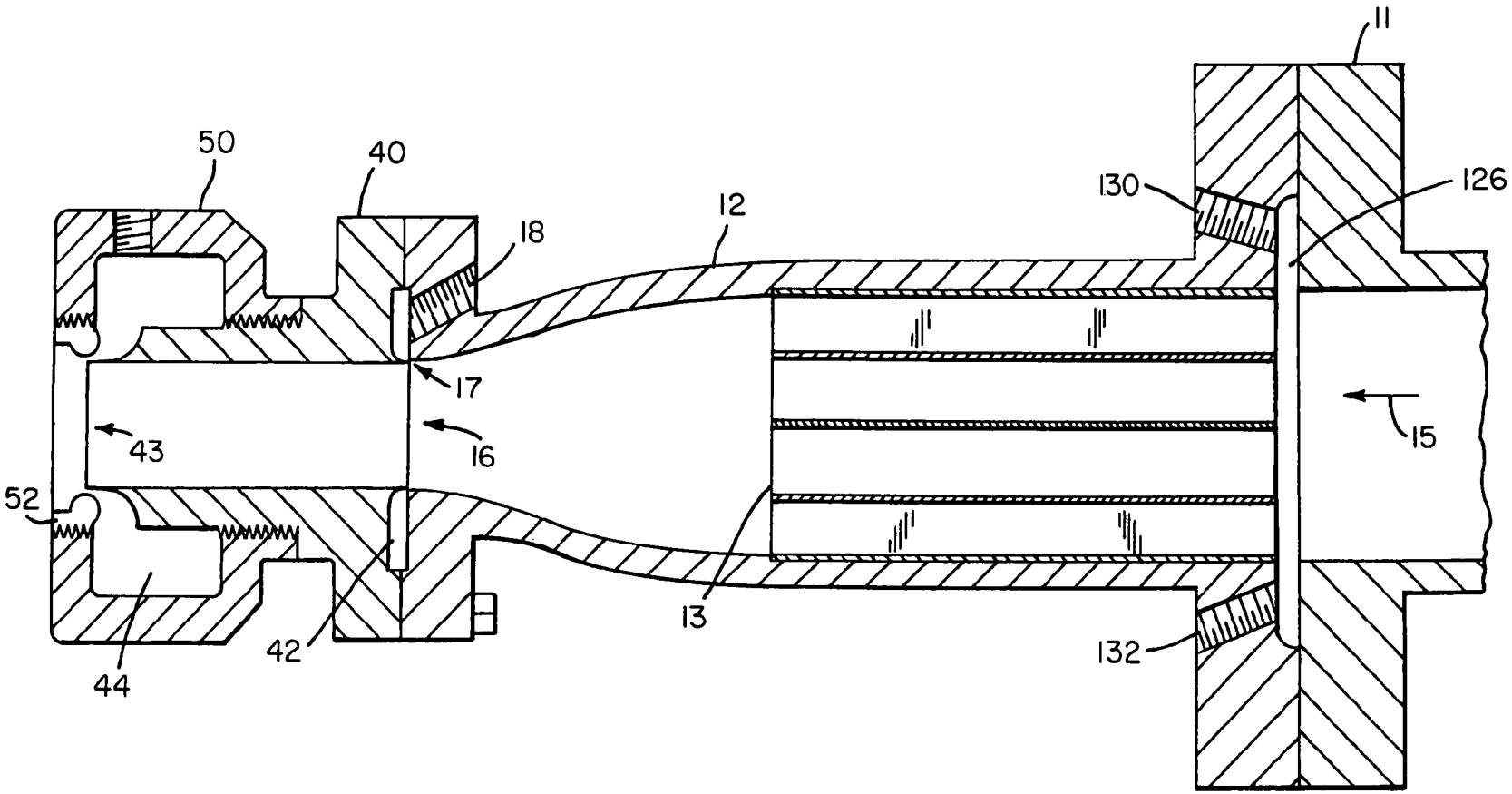
FIG. 8 shows an alternative embodiment of the nozzle assembly of FIG. 1 wherein the accelerator tip is connected directly to the reducing flange.

FIG. 8 shows an alternative assembly where the accelerator tip 40 is connected directly to the reducing flange 12. Like reference numerals depict like elements. Since two intermediate flanges do not appear in this embodiment, the differential bore diameters at the mating junction between flanges 12 and 40 is about fifteen thousandths of an inch as depicted by gap 17, Gap 17 channels boundary layer fluid into annular chamber 42 of the accelerator tip. The abridged nozzle assembly of FIG. 8 includes an annular undercut 126 and a pair of ⅜" NPT Taps 130 and 132 about 180° apart. The accelerator tip 40 includes an annular undercut 42 to define a chamber that may optionally receive return (e.g., recycle) fluid through at least one of ⅜" NPT tap 18. These taps may also carry probes to measure the fluid supply pressure. Reducing flange 12 may be attached to a standard fire truck supply flange 11 to supply a source of fluid generally indicated at 15. A secondary high pressure pump (not shown) siphons water from the NPT taps of the flange(s) to supply accelerator tip 40 with a higher pressure (higher speed) flow in order to accelerate the outer periphery of the primary water stream ejected from accelerator tip flange 40. This is intended to achieve equiplanar ejection at the nozzle by compensating for drag on the outer surface of primary fluid stream (i.e., boundary layer effect) imposed by internal resistance of flange sections. It is believed that siphoning/scraping off a ring of five thousandth inch will effectively remove the boundary layer effect, but this width may be adjusted according to the primary pressure and flow supplied by flange 11. The type of material used for the nozzle may also impact the depth of the boundary layer.

Figure 9:
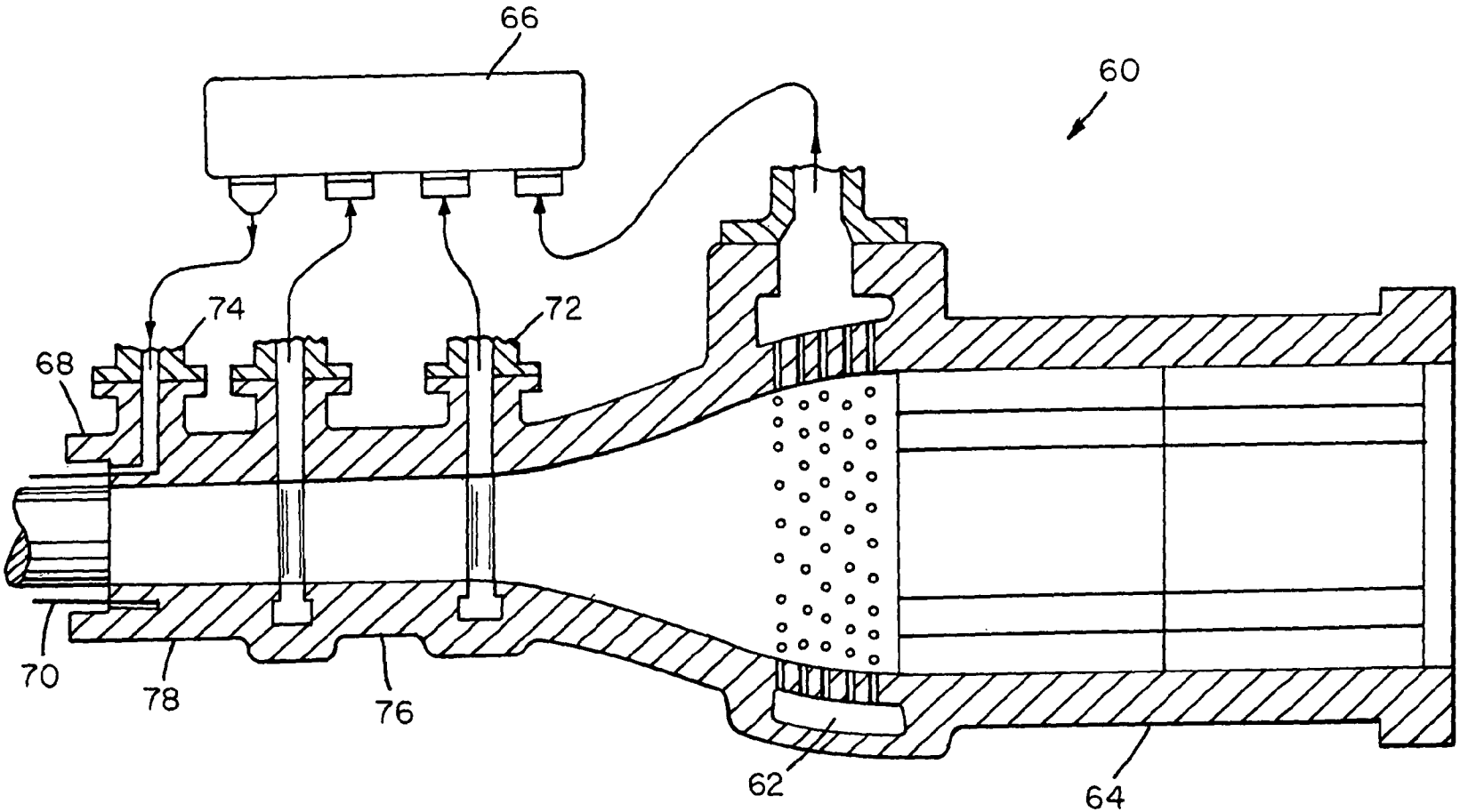
FIG. 9 shows yet another embodiment of the nozzle depicting a bleed section in the reducing flange thereof to bleed off at least a portion of the boundary layer.

FIG. 9 shows yet a further embodiment of a solid stream nozzle 60 having a bleed section 62 in the reducing flange 64 to bleed off at least a portion of the boundary layer. In this embodiment, a gerotor pump 66 increases the pressure of fluid bled from reducing section 62 and supplies the same to an accelerator tip 86 to generate a high speed jet 70 in the form of an annular ring around the outer periphery of the primary fluid stream. Addition taps 72 and 74 are provided by intermediate flange sections 76 and 78 to strip off additional boundary layer fluid via slots 73 and 75 between flange sections. These taps also supply pump 66 with boundary layer fluid.

Figure 10:
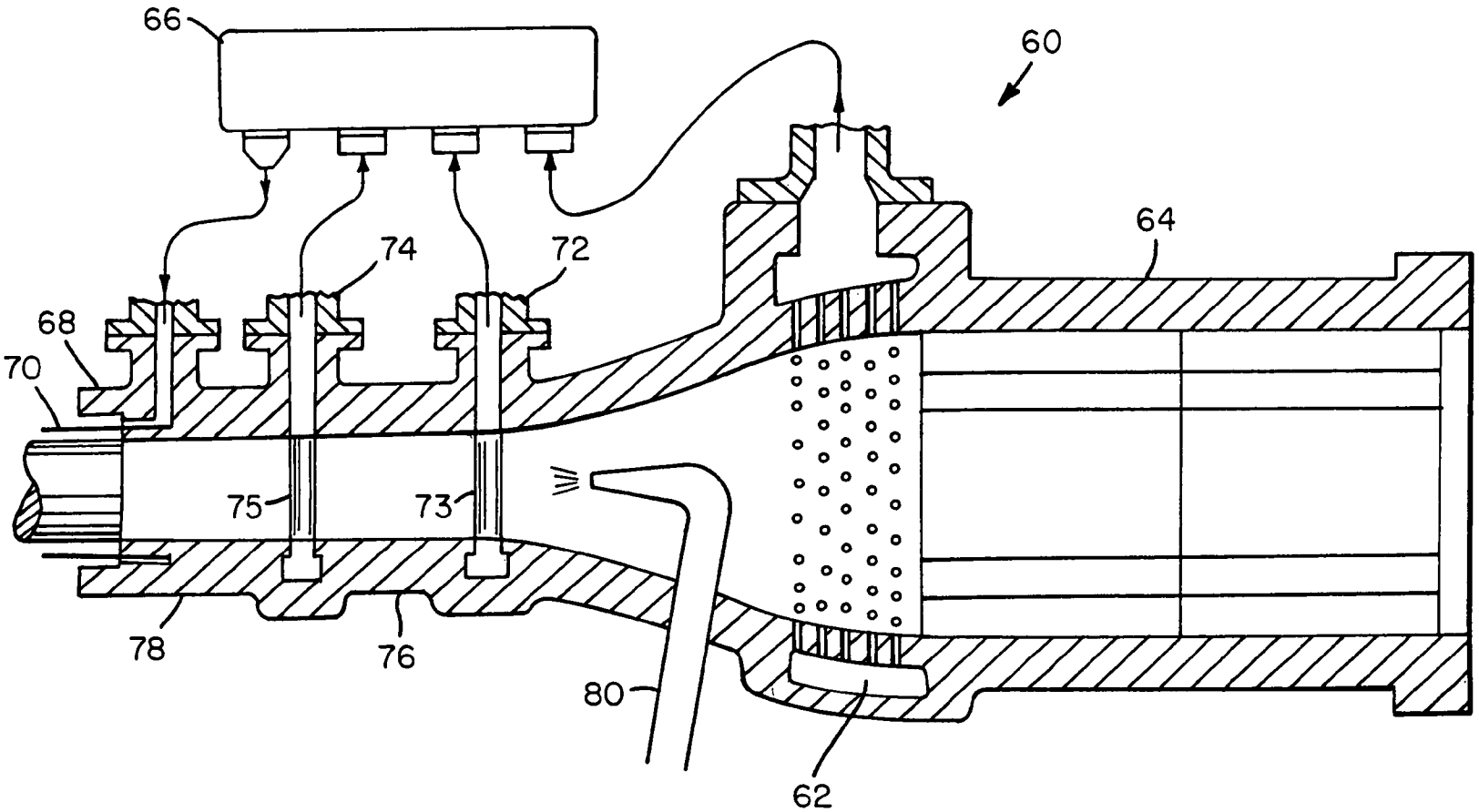
FIG. 10 shows yet a further embodiment of the nozzle having an injector tube that enables mixing of a substance into the primary fluid stream.

FIG. 10 shows depicts the nozzle assembly of FIG. 9 modified with the addition of an injector tube 80 to inject and/or mix a viscosifier or gelling agent within the fluid stream whereby to enhance cohesion (and effective reach) upon ejection of the fluid from nozzle tip 68. Such viscosifiers and gelling agents are commercially available. Viscosifiers may include a glycol or even a refrigerant to solidify or supercool the fluid stream within the confines of the nozzle so that the fluid solidifies upon slight expansion after ejection. Due to their reaction times, such viscosifiers may be injected further upstream of the primary fluid stream to allow addition time to react before ejection. In addition or as an alternative, an injector nozzle 80 may inject a chemical or other substance into the fluid stream for the particular application at hand.

Figure 11:
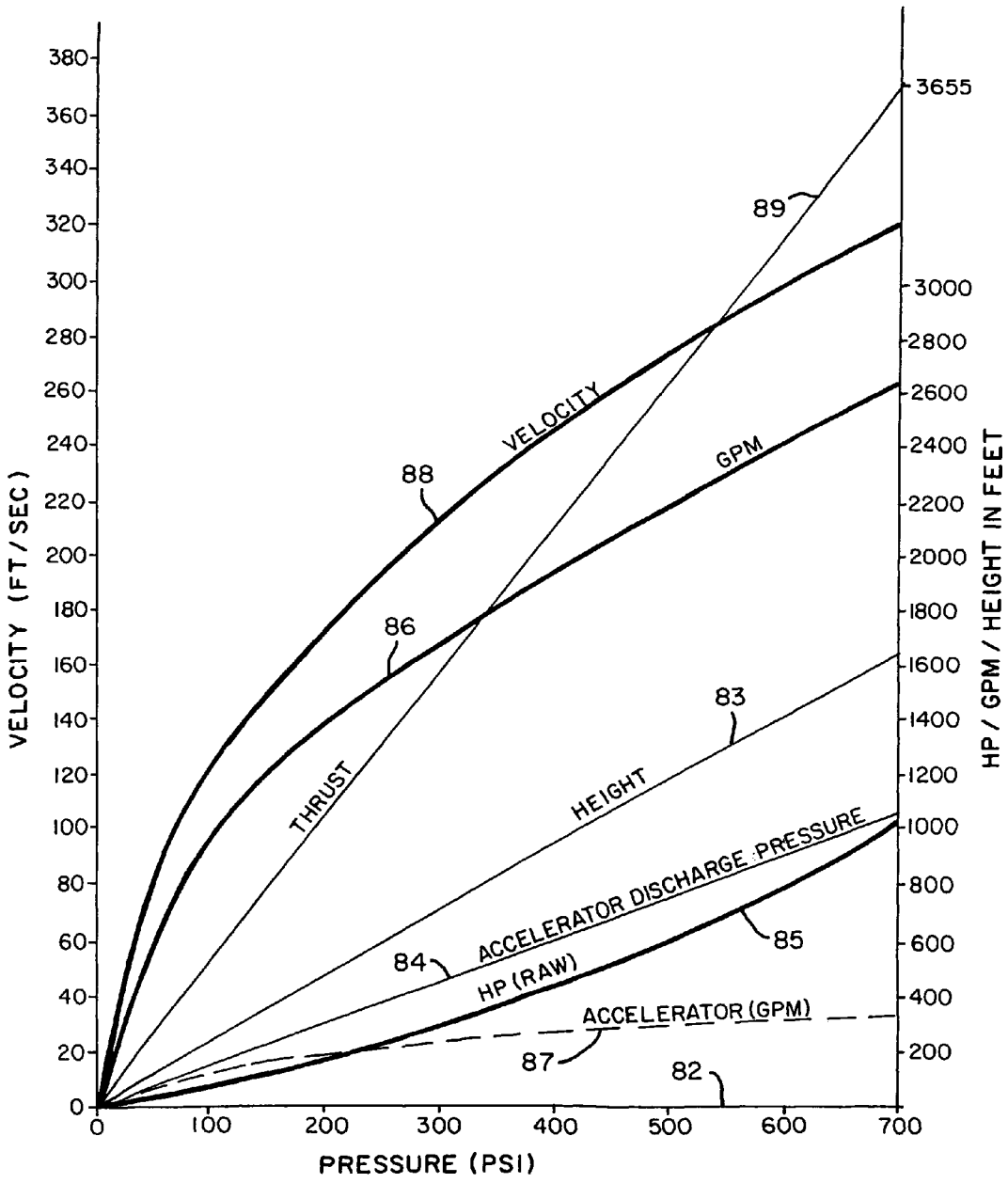
FIG. 11 show theoretical performance values of certain parameters associated with stream dynamics.

FIG. 11 shows theoretical performance curves as a function of pressure for the exemplary nozzle described herein. The horizontal axis 83 shows the primary fluid pressure applied to the input of the reducing flange. Curve 83 shows the theoretical height attainable by the exemplary nozzle, which ranges from about 300 feet at 200 psi to 1150 feet at 500 psi. The horizontal throw distance is about three to four time the height. However, the actual height attainable by the solid stream before dispersion will vary according to fluid viscosity, ambient wind conditions, effectiveness in removing/reducing boundary layer effects within the nozzle, Reynolds number (above 3000) of the fluid which tends to destroys laminar flow, properly collimating the stream at the accelerator tip to achieve equiplanar discharge, removing/reducing perturbations in the pump supply pressure that impact stream cohesion, discontinuities in internal pressures within the water nozzle, and reducing the impact of entrained substances in the fluid (e.g. gases, debris, etc.). The theoretical lateral distance of a projected stream of water is determined by the projected angle above the horizontal (azimuth), discharge velocity of the water from the nozzle, stream diameter, dispersion inherent in the unconfined water stream, and atmospheric effects. In view of these factors, the actual height and effective range attainable is believed to range between 50-80% of the theoretical height and range, which is still substantially further than conventional nozzles.

As a function of primary pressure, curve 84 shows the required pressure supplied to the accelerator housing, curve 85 shows the raw horse power (without pump or engine losses) required to produce the required fluid pressure and flow, curve 86 shows the primary fluid flow rate, curve 87 shows the secondary fluid flow rate at the accelerator tip, curve 88 shows the velocity of the primary stream ejected from the nozzle, and curve 89 shows the thrust or reaction produced by the nozzle.

Figure 12:
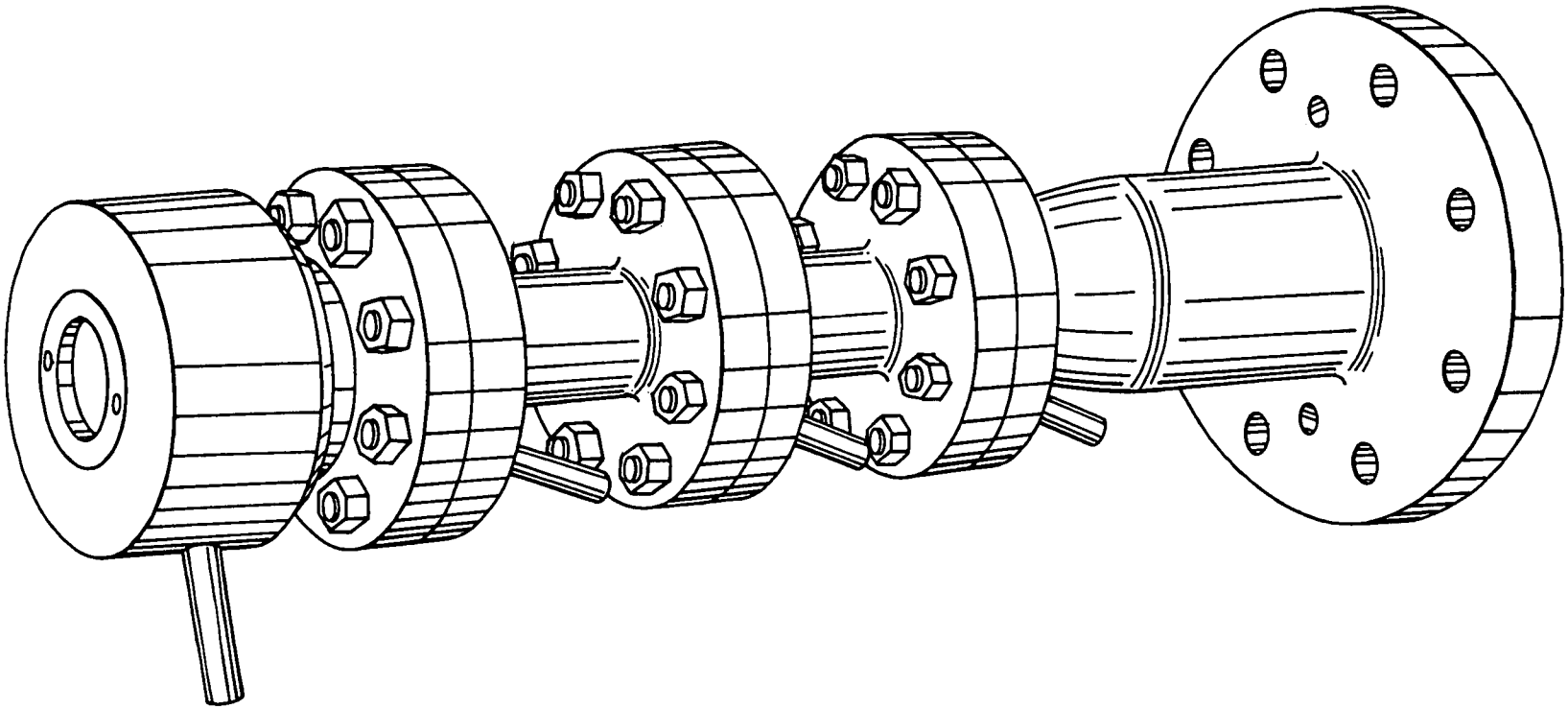
FIG. 12 shows front perspective view of the nozzle assembly of FIG. 1 viewed from the stream ejecting end.
Figure 13:
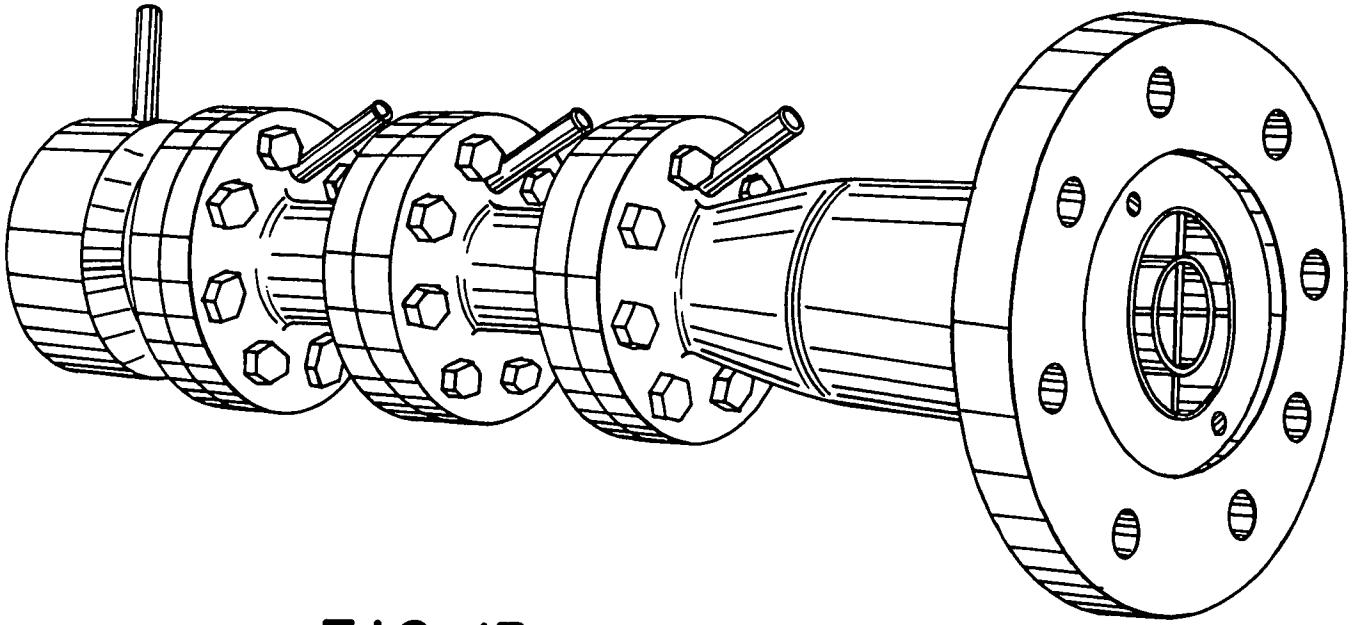
FIG. 13 shows a rear perspective view of the nozzle assembly of FIG. 1 viewed from the nozzle input end.

FIG. 12 is front perspective view of the exemplary nozzle assembly viewed from the stream ejection end while FIG. 13 shows a rear perspective view of the assembly view from the nozzle input end. These show the extraction tubes for the boundary layer chambers and a single supply tube for the accelerator tip housing. This model comprised 316 Stainless Steel, weighed approximated 134 pounds, has a base diameter of thirteen inches, is thirty inches in height, and has an inlet bore of 3.6 inches, a discharge diameter of 1.8 inches, an operating pressure of 200-700 psi, and a flow rate of 1250-3000 gpm.

The invention is not limited to the specific embodiments shown or described, or to the operating parameters discussed herein.

We claim:

1. A method of projecting a substantially coherent fluid stream comprising:

generating a high-pressure fluid source, supplying a nozzle with said high pressure fluid source to drive a fluid stream through a bore of said nozzle, reducing boundary layer effects of said nozzle by bleeding off an annular ring of fluid around the fluid stream during pressurized operation of said nozzle, and ejecting said coherent fluid stream after reducing said boundary layer effects.

2. The method of claim 1, further comprising:

generating and applying a secondary higher pressure fluid source to an accelerating tip of said nozzle to generate and apply a higher speed annular jet around the periphery of said fluid stream after ejection from said nozzle.

3. The method of claim 2, wherein said annular jet is generated by applying said secondary higher pressure source to an annular chamber that circumscribes an ejector tip of said nozzle.

4. The method of claim 3, wherein fluid from said secondary higher pressure source is derived from a boundary layer chamber bled from a peripheral region of said nozzle bore.

5. The method of claim 1, further including injecting a viscosifier into the stream prior to ejection from the nozzle.

6. A solid stream nozzle comprising:

a first flange (12) to receive fluid from a pressurize fluid source through a first bore thereof, a second flange (20) that mates and is axially aligned with said first flange (12) to receive said fluid through a second bore that is smaller than said first bore, a bleed chamber (22) defined between said first and second flanges (12, 20) to continuously extract fluid through a relief tap (18) a thin boundary layer region of fluid from a peripheral region of the bores between said first and second flanges during pressurized operation of said nozzle, and a tip that is axially aligned with said bores to eject a solid stream of fluid.

7. The solid stream nozzle of claim 6 wherein said first flange includes a flow straightener.

8. The solid stream nozzle of claim 7 wherein said bleed chamber (22) is defined by a recessed undercut (22) in said second flange (20) to form a peripheral sharp edge scraper ring (406) between mating flange sections of said first and second flanges to bleed off high pressure fluid from said nozzle bore through said recessed undercut (22) to said relief tap (18).

9. The solid stream nozzle of claim 8, further including:

a pump in communication with said chamber to receive and further pressurize said boundary layer fluid and to supply higher pressure fluid to an accelerator chamber circumscribing said tip.

10. The solid stream nozzle of claim 9 wherein said nozzle tip includes a high pressure chamber circumscribing said tip to produce and apply an annular high speed fluid jet around the fluid stream.

11. The solid stream nozzle of claim 10, wherein said high pressure chamber of said tip includes a contoured discharge ring that is axially positionable to adjust the mass flow volume of said annular jet by altering the gap width between said discharge ring and said tip.

12. The solid stream nozzle of claim 11 wherein said adjustable ring includes a surface to direct said annular jet approximately 4° inward of said axis of flow of said fluid stream.

13. The solid stream nozzle of claim 6 including at least a third flange interposed between said second flange and said tip, said third flange additionally including an undercut at the mating surface between a preceding flange and an inlet collar thereof to define a boundary layer chamber that removes boundary layer fluid from said fluid stream.

14. The solid stream nozzle of claim 6 wherein said pressurized fluid source is pressurized above 200 psi.

15. The solid stream nozzle of claim 6, wherein said pressurize fluid source is derived from a pressurized tank of fluid.

16. The solid stream nozzle of claim 6, further including an injector to inject a viscosifier into the fluid stream.

* * * * *